US010381145B2

(12) United States Patent
Bertram et al.

(10) Patent No.: US 10,381,145 B2
(45) Date of Patent: Aug. 13, 2019

(54) METHOD FOR DETERMINING A SWITCHING FUNCTION FOR A SLIDING MODE CONTROLLER, AND SLIDING MODE CONTROLLER

(71) Applicant: Robert Bosch GmbH, Stuttgart (DE)

(72) Inventors: Torsten Bertram, Düsseldorf (DE); Ingo Glowatzky, Karlstadt (DE); Christoph Krimpmann, Dortmund (DE); Georg Schoppel, Lohr (DE)

(73) Assignee: Robert Bosch GmbH, Stuttgart (DE)

( * ) Notice: Subject to any disclaimer, the term of this patent is extended or adjusted under 35 U.S.C. 154(b) by 382 days.

(21) Appl. No.: 15/066,165

(22) Filed: Mar. 10, 2016

(65) Prior Publication Data

US 2016/0266600 A1 Sep. 15, 2016

(30) Foreign Application Priority Data

Mar. 10, 2015 (DE) ..... 10 2015 204 258

(51) Int. Cl.

*G05G 1/02* (2006.01)
*H01F 7/18* (2006.01)
*F15B 13/044* (2006.01)

(52) U.S. Cl.

CPC ..... *H01F 7/1844* (2013.01); *F15B 13/0442* (2013.01); *H01F 2007/1866* (2013.01)

(58) Field of Classification Search

CPC ..... H01F 7/1844; H01F 2007/1866; F15B 13/0442; F01P 7/044; F02B 2730/095; F02M 9/106; B21B 37/62; B24B 23/043; B60P 1/4471; B62D 11/005; G05G 1/025; G05B 15/02

See application file for complete search history.

(56) References Cited

U.S. PATENT DOCUMENTS 7,231,265 B2 * 6/2007 Yasui ..... F02D 41/1403 700/29
8,211,359 B2 * 7/2012 Beane ..... B30B 11/005 264/40.3

OTHER PUBLICATIONS

Krettek et al.; Evolutionary Hardware-in-the-Loop Optimization of a Controller for Cascaded Hydraulic Valves; Advanced Intelligent Mechatronics International Conference; Sep. 4-7, 2007; pp. 1-6; IEEE Xplore.

* cited by examiner

*Primary Examiner* — Cuong B Nguyen
(74) *Attorney, Agent, or Firm* — Maginot, Moore & Beck LLP

(57) ABSTRACT

The disclosure relates to a method for determining a switching function for a sliding mode controller for controlling a controlled variable of a system, the switching function being selected as a function of a control deviation of the controlled variable and its time derivatives up to at least the second order and on the basis of initial control dynamics of the system, coefficients of the switching function being represented by means of poles of a closed control loop of the system, the poles each being selected as a function of the control deviation, and desired control dynamics of the system being set by shifting at least one first pole of the poles, and to such a sliding mode controller and to a use of such a controller.

18 Claims, 4 Drawing Sheets

METHOD FOR DETERMINING A SWITCHING FUNCTION FOR A SLIDING MODE CONTROLLER, AND SLIDING MODE CONTROLLER

This application claims priority under 35 U.S.C. § 119 to application no. DE 10 2015 204 258.8, filed on Mar. 3, 2015 in Germany, the disclosure of which is incorporated herein by reference in its entirety.

BACKGROUND

The present disclosure relates to a method for determining a switching function for a sliding mode controller for controlling a controlled variable of a system and to a sliding mode controller and to a use of such a controller.

Controlling hydraulic valves, for example hydraulic directional valves, is a demanding task on account of technical and non-technical requirements. In such valves, a volumetric flow of a hydraulic fluid is controlled using the position of a piston which moves inside the valve body. In this case, the position of the piston itself is controlled, for example, by means of an electromagnet or two counteracting electromagnets.

In this case, the magnet(s) is/are accordingly counteracted by one or two control springs which center the piston at a hydraulic zero point if the magnets are not energized. Furthermore, static friction and sliding friction also act inside the valves and need to be taken into account when controlling the valves, just like magnetic hysteresis and eddy current effects inside the corresponding magnetic circuits. In addition, flow forces occur on the slider or the piston when there is a flow through the valve, which likewise has to be taken into account during control.

These properties of hydraulic valves impose high demands on a position controller of the piston. A combination of a PI controller with state feedback, for example, can be used to control the piston position of hydraulic directional valves. Such a controller is then usually supplemented with non-linearities in the P and I branches in order to adapt the gains of the individual branches independently of one another for different signal ranges and to take into account the properties of the controlled system, that is to say the valve. However, these non-linearities result in a large number of coupled parameters which are typically manually interpreted when designing a controller.

For this purpose, step responses of different step heights are then usually measured and the controller parameters are varied until the system behavior corresponds to the desired requirements. One approach for automating such a procedure is known, for example, from Krettek et al: "Evolutionary hardware-in-the-loop optimization of a controller for cascaded hydraulic valves", IEEE/ASME International Conference on Advanced Intelligent Mechatronics, 1-6, 2007.

However, development and activation times of such controllers and the associated costs are subject to ever more restrictive budgeting, with the result that a conventional design of controllers for hydraulic valves is becoming more and more difficult.

It is therefore desirable to provide a controller, for example for hydraulic valves, which, on the one hand, is simple to parameterize and, on the other hand, provides the same control quality as previously used controllers with a reduced complexity.

SUMMARY

The disclosure proposes a method for determining a switching function for a sliding mode controller as well as a sliding mode controller and a use of such a controller having the features of disclosure.

Advantages of the Disclosure

A method according to the disclosure is used to determine a switching function for a sliding mode controller for controlling a controlled variable of a system. In this case, the switching function is selected as a function of a control deviation of the controlled variable and its time derivatives up to at least the second order and on the basis of initial control dynamics of the system. Coefficients of the switching function are represented by means of poles of a closed control loop of the system and are each selected as a function of the control deviation. Desired control dynamics of the system are then set by shifting at least one first pole of the poles.

State controllers are generally designed using a section model. However, since, from the point of view of control engineering, a sufficient model for a hydraulic directional valve, for example, does not exist or at least can be determined only with a considerable amount of effort, that is to say an excessive amount of effort in practice, only structure-variable controllers or manually optimized PI controllers, as mentioned above for example, can usually be used in this case. The sliding mode controllers included in this class are distinguished by the fact that they are invariant with respect to parameter uncertainties of a section model or else can be used without a section model.

A sliding mode controller is based on a switching function which is a weighted sum of states of the system to be controlled. Based on the assumption that the controlled system can be described in a controllable canonical form, the states may be, for example, a size, for example a position, or a control error of this position and its time derivatives. For example, a control error, a speed deviation and an acceleration error can be used as states.

The switching function is therefore used to establish a relationship between the individual state variables. The so-called switching level, which corresponds to a hyperplane in the state space defined by the value zero of the switching function, represents a linear differential equation in homogeneous form in this case. Here, the coefficients of said differential equation are selected depending on the desired dynamics of the system to be controlled or the controlled variable. For example, in the case of a differential equation describing a variable position, it is possible to predefine a desired damping of the movement which is reflected in the speed coefficient, that is to say the first time derivative of the position.

In the case of sliding mode control, an attempt is now made to change the value of this switching function to zero and to keep it there. Therefore, the system would follow the desired dynamics during control. A manipulated variable, which may be a current in an electromagnet in the case of a hydraulic valve for example, can then be set on the basis of the instantaneous value of the switching function, with the result that the value of the switching function moves in the direction of zero under the influence of the manipulated variable on the system or the control error. Under ideal conditions, a constant absolute value could be selected for the manipulated variable in this case, a positive or negative value depending on the mathematical sign of the switching function. Such a dependence of the manipulated variable on the value of the switching function is also referred to as the control law in this case.

Under real conditions, for example limited switching frequency and consideration of sensor and actuator dynamics, the control law mentioned results in a deficient control quality, however, which is why it is also possible to use second-order sliding mode controllers in which both the switching function and its first time derivative are stabilized, that is to say not only the switching function itself but also its first time derivative are changed to the value zero and then kept there. This is carried out, for example, by means of a continuous control law, that is to say the absolute value of the manipulated variable varies on the basis of the value of the switching function. For example, the value of the manipulated variable can be selected to be lower, the lower the value of the switching function.

A linear switching function, as has been described hitherto, results in the closed control loop of the system associated therewith likewise having linear dynamics. In practice, however, non-linear dynamics are often desirable, in the case of which the controlled system achieves very rapid compensation in the case of slight deflections, for example, but reacts more slowly in the case of large step changes of the reference variable in order to avoid impairing the stability of the system.

Such a linear switching function initially results using the described step of selecting the switching function as a function of the control deviation and its derivatives up to at least the second order. For example, the switching function s can then have the form $s(e,\dot{e},\ddot{e})=r_0e+r_1\dot{e}+\ddot{e}$, where $r_0$, $r_1$ are the corresponding coefficients and $e,\dot{e},\ddot{e}$ are the control deviation and its first and second time derivatives. The second order is selected here because it is generally sufficient to describe a hydraulic valve and its dynamics with sufficient accuracy. Nevertheless, higher orders may also be concomitantly included in the method described in the present case. Predefining the coefficients of the switching function using initial control dynamics of the system then results in an initially linear switching function with dynamics already approximately corresponding to desired dynamics, for example, but not yet accurately matched to a desired control behavior of an available system.

The further step of representing the coefficients of the switching function by means of poles of a closed control loop of the system can then be carried out, for example, by simply comparing the coefficients, in which case it is taken as a basis that a linear switching function can be represented by the poles which determine the control behavior or the dynamics in an associated closed control loop. This can be carried out, for example, by repeatedly applying an operator of the form $(d/dt-\lambda_i)$, where $\lambda_i$ is the ith pole of the closed control loop, to the control deviation. Applying this operator twice gives, for example, a switching function of the form $s(e,\dot{e},\ddot{e})=\lambda_1\lambda_2e-(\lambda_1+\lambda_2)\dot{e}+\ddot{e}$ with the poles $\lambda_1$ and $\lambda_2$. The poles can then be determined, for example, by comparing the coefficients. Statements regarding the dynamics, stability and convergence rate of the control loop can be made using the poles.

In the subsequent particularly advantageous step, the poles are now each selected as a function of the control deviation, that is to say the poles $\lambda_i$ are selected in the form $\lambda_i=\lambda_i(e)$. In this manner, a non-linear switching function results from the linear switching function. This can therefore take into account the desire that greater dynamics are required for small control errors, by suitably selecting the poles.

In a further step, desired control dynamics of the system can now be set by shifting at least one first pole of the poles, for example $\lambda_1$. This now makes it possible to quickly adapt the switching function to a desired control behavior or desired dynamics by simply adapting or shifting one or else more poles, whereas a non-linearity for adapting the control behavior in the case of small and/or large control deviations, for example, is nevertheless present. As a result of this analytical approach with a very small number of parameters to be determined, it is no longer necessary to determine a large number of different, possibly also coupled, parameters, as is the case with conventional determination of the individual coefficients of a non-linear switching function, for example by means of numerical methods. It is therefore possible to set a sliding mode controller in a quick and cost-effective manner. In addition, in comparison with other methods, this method affords the advantage that the parameterization of the switching function can be intuitively understood from control engineering aspects since the influence of the poles of the closed control loop on the control behavior, namely the control speed for example, is known.

The first pole is preferably selected as a linear function of the control deviation, in particular by means of a first constant multiplied by an absolute value of the control deviation and an additive, second constant. For example, it is possible to select the first and dominant pole $\lambda_1$ in the form $\lambda_1(e)=\Delta\lambda|e|+\lambda_0$. The dominant pole decisively determines the dynamics of the system. In this case, $\Delta\lambda$, which is expediently selected to be greater than zero, is a gradient of a linear equation and $\lambda_0$, which is expediently selected to be less than zero, is the associated ordinate intercept. The dynamics of the controller can therefore be adapted by shifting the first pole. For example, faster dynamics can be achieved by means of a shift to the left, that is to say toward negative values with greater absolute values.

Alternatively, the first pole can also be selected as a function of at least the second order of the control deviation. A smaller change in the dynamics can therefore be achieved for smaller control errors, for example.

Alternatively, the first pole can also be selected as a square root function of the control deviation. A greater change in the dynamics can therefore be achieved for smaller control errors, for example.

The remaining poles are advantageously each selected to be proportional to the first pole. For example, it is possible to select the poles $\lambda_i$ in the form $\lambda_i(e)=c_i\lambda_1(e)$. Such coupling of the remaining poles to the first pole enables an even smaller number of parameters to be set when creating the switching function since the remaining poles are concomitantly shifted when shifting the first pole. The constants $c_i$ can be empirically determined, for example, or else can also be optimized together with the other parameters.

It is advantageous if a hydraulic system, in particular a hydraulic valve, is used as the system and if a position of a piston or a volumetric flow of the hydraulic system, in particular, is used as the variable. As already mentioned at the outset, the controlled system usually cannot be adequately modeled or at least can be modeled only with a considerable amount of effort in terms of control engineering, in particular in hydraulic systems such as hydraulic valves or hydraulic directional valves, with the result that the method presented here provides a particularly effective possible way of providing a controller. However, it is emphasized that the presented control is particularly suitable for all systems which can be controlled using a sliding mode controller and/or for which a non-linear switching function is desired.

A switching function for a sliding mode controller, as has been presented, can be determined, for example, using a multi-criteria algorithm as part of hardware-in-the-loop experiments in which a hydraulic valve, in particular a hydraulic directional valve, for example, is used as the system. In this case, all potential solutions are tested directly on the valve, for example, and real step responses are assessed. In this case, the step responses are assessed, for example, in the sense of so-called Pareto optimality using a plurality of criteria which assess the rise time, the transient response and the average error in the rest position independently of one another.

A sliding mode controller according to the disclosure is used to control a controlled variable of a system and comprises a switching function which has been determined in accordance with a method according to the disclosure.

A dependence on a value of the switching function is preferably predefined for a value of a manipulated variable of the controller.

The value of the manipulated variable is advantageously predefined as a function which comprises a part proportional to a root of the absolute value of the switching function.

This can be carried out, for example, in the form $$\dot{u}_1 = -\alpha\sqrt[3]{|s|}\,\mathrm{sign}(s)$$

where u is the value of the manipulated variable and β is a proportional gain factor. Furthermore, u may comprise an additive part $u_1$ whose time derivative is $\dot{u}_1=-u$ for $|u|>U_M$ and $$u = -\beta\sqrt{|s|}\,\mathrm{sign}(s),$$

for $|u|\leq U_M$. In this case, α indicates an integral gain factor and $U_M$ indicates a maximum value for the manipulated variable. This makes it possible to provide a controller using a continuous control law, which controller makes it possible to stabilize both the switching function and its first time derivative, that is to say it is possible to take into account real conditions such as a limited switching frequency or sensor and actuator dynamics.

A sliding mode controller can be implemented, for example, by means of accordingly installed hardware and software in a computing unit. For example, corresponding inputs for capturing signals, for example with respect to an instantaneous position of a piston if this is a controlled variable, may also be provided for this purpose. It is also expedient, for example, to fit the corresponding hardware or electronics to a valve to be controlled. A computing unit according to the disclosure is accordingly set up, in particular in terms of programming, to carry out a method according to the disclosure.

The implementation of the sliding mode controller in the form of a computer program is advantageous since this gives rise to particularly low costs, in particular if an executing control device is also used for other tasks and is therefore present anyway. Suitable data storage media for providing the computer program are, in particular, magnetic, optical and electrical storage devices, for example hard disks, flash memories, EEPROMs, DVDs and many more. It is also possible to download a program via computer networks (Internet, intranet etc.).

A use according to the disclosure of a sliding mode controller according to the disclosure is used to control a controlled variable of a system, in which case the value of the manipulated variable is set on the basis of a value of the switching function, in particular.

With respect to further advantageous configurations and advantages of a controller according to the disclosure and of its use, reference is made to the statements above in order to avoid repetitions.

Further advantages and configurations of the disclosure emerge from the description and the accompanying drawing.

BRIEF DESCRIPTION OF THE DRAWINGS

Exemplary embodiments of the disclosure are presented in the drawings an are explained in more detail in the description below.

In the drawings.

DETAILED DESCRIPTION

Figure 1:
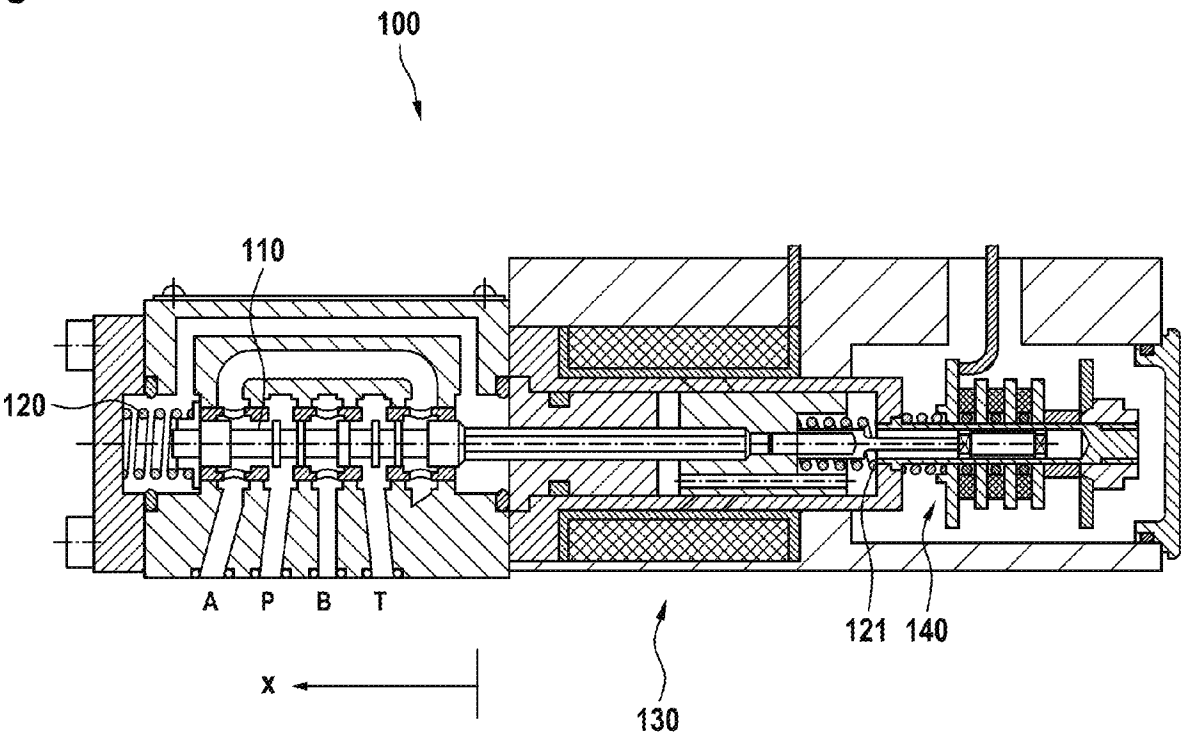
FIG. 1 schematically shows a hydraulic directional valve, for the control of which a sliding mode controller according to the disclosure can be used.

FIG. 1 schematically shows, by way of example, a system 100 which is in the form of a hydraulic directional valve and for which a sliding mode controller according to the disclosure in a preferred embodiment can be used for control.

The hydraulic directional valve 100 has a piston 110 which can be moved in a housing in order to connect pressure connections P for a pump, T for a tank and working connections A and B to one another in a suitable manner. A restoring force is applied to the piston 110 at one housing end by means of a spring 120 and a setting force is applied to the piston 110 at another housing end by means of an electromagnet 130. A further spring 121 acts against the spring 120 in order to keep the piston 110 at a zero position without magnetic force.

A voltage can be applied to the electromagnet 130 in order to move the piston 110, depending on the value of the voltage. A displacement transducer 140 is also provided in order to detect a position and possibly a speed and an acceleration of the piston 110 and to forward this signal to a processing unit. In this respect, it is mentioned that the valve shown has, by way of example, only one electromagnet for controlling the piston. However, it is likewise conceivable for a valve having a plurality of electromagnets to be used.

Figure 2:
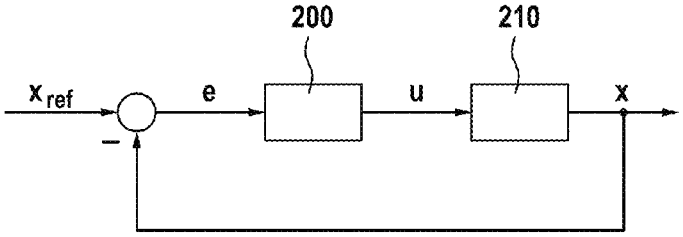
FIG. 2 schematically shows a control loop having a sliding mode controller according to the disclosure in a preferred embodiment.

FIG. 2 shows a simple control scheme which can be used to control the position x of the piston 110 of the hydraulic directional valve 100 as a controlled variable, for example. A desired or reference value $x_{ref}$ for the position can initially be predefined. A control deviation $e=x-x_{ref}$ is formed from an actual value x of the position which is fed back, and is supplied to the sliding mode controller 200. According to the procedure already mentioned above, the sliding mode controller uses the switching function s(e) to determine a value for the manipulated variable u which, in this case, is the voltage to be applied to the electromagnet 130. The position x of the piston 110 is then influenced using a controlled system 210. At this juncture, it is mentioned again that the exact influence of the manipulated variable via the controlled system is not relevant to a sliding mode controller.

In addition to the desired value $x_{ref}$, the actual value x and the control deviation e, their respective first and second time derivatives are also concomitantly included in the control, as was explained in detail above. FIG. 2 illustrates only the respective variables which are not derived only for the sake of clarity.

Figure 3:
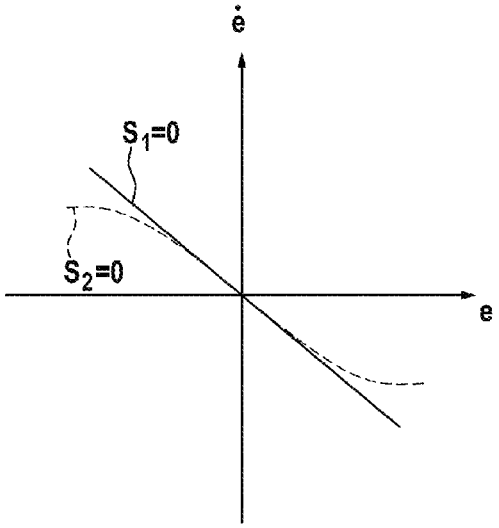
FIG. 3 schematically shows a two-dimensional illustration of a switching function which is not according to the disclosure and a switching function according to the disclosure in a preferred embodiment for a sliding mode controller.

FIG. 3 now shows two switching levels $s_1=0$ and $s_2=0$ of two switching functions $s_1$ and $s_2$ in a graph. In this case, the first time derivative $\dot{e}$ of the control deviation is plotted against the control deviation e. In this respect, it is noted that only switching levels of first-order switching functions are shown, by way of example, owing to the limited and simpler representability. Strictly speaking, the switching levels are therefore only switching lines.

The switching line $s_1=0$ belongs to a linear switching function of the form $s_1(e, \dot{e})=r_0e+\dot{e}$ or $s_1(e,\dot{e})=\lambda_1e-\dot{e}$ with a constant $\lambda_1$. In contrast, the switching line $s_2=0$ belongs to a non-linear switching function of the form $s_2(e,\dot{e})=\lambda_1-\dot{e}$ with $\lambda_1=\lambda_1(e)$. Suitably selecting $\lambda_1$ as a function of e therefore makes it possible to achieve a desired curvature of the switching lines, which is indicated only by way of example in FIG. 3. In this respect, it is also noted that such non-linear switching functions can accordingly also be formed for higher orders.

Figure 4:
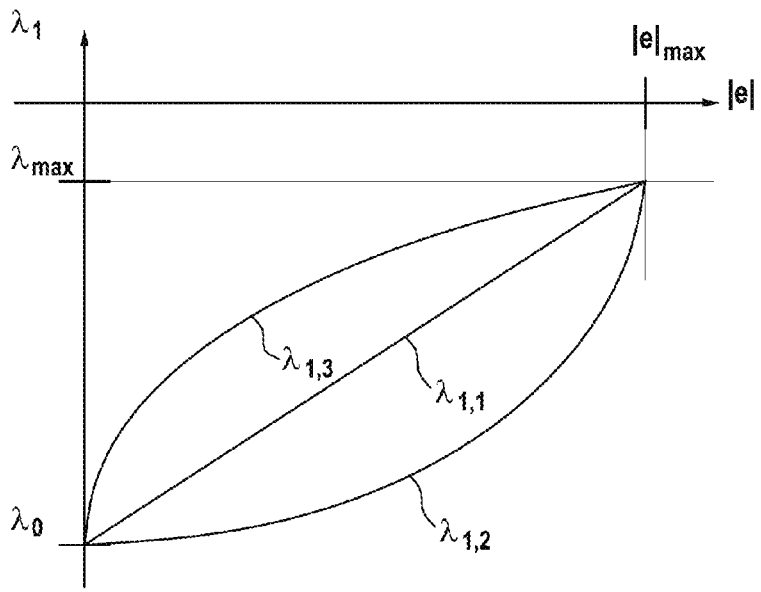
FIG. 4 shows, in a graph, illustrations of a pole of a closed control loop in various preferred embodiments, as can be used for a switching function according to the disclosure.

FIG. 4 shows various possible embodiments for $\lambda_1=\lambda_1(e)$ in a graph. $\lambda_{1,1}$ is a linear function of the form $\lambda_1(e)=\Delta\lambda|e|+\lambda_0$, where $\Delta\lambda$ is a gradient and $\lambda_0$ is an associated ordinate intercept, as already explained above. In this manner, a first pole with a smaller absolute value results for control deviations with larger absolute values and a first pole with a larger absolute value results for control deviations with smaller absolute values.

It is therefore possible to take into account the dynamics mentioned at the outset and often desired in practice with very fast compensation for small deflections, but a slow reaction in the case of step changes in the reference variable.

A quadratic and a square root dependence of the first pole are shown, by way of example, with $\lambda_{1,2}$ and $\lambda_{1,3}$. These are further possible ways of deliberately influencing the dynamics on the basis of the control deviation, as already explained above.

Figure 5:
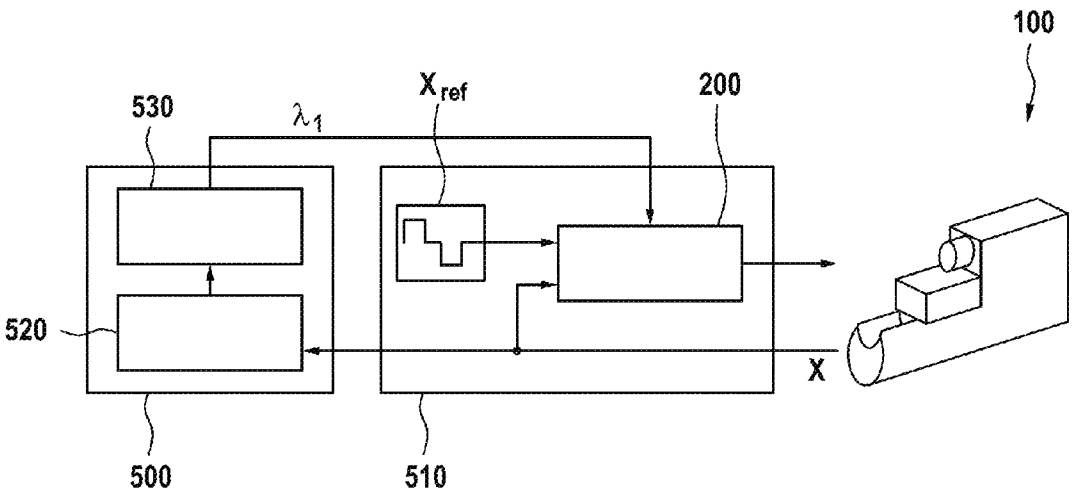
FIG. 5 schematically shows a possible sequence of a method according to the disclosure in a preferred embodiment.

FIG. 5 schematically shows a possible sequence of a method according to the disclosure in a preferred embodiment for determining a switching function for a sliding mode controller. This is a hardware-in-the-loop experiment in which the system having the controlled variable, the hydraulic directional valve 100 having the position x of the piston in the present case, is connected to a computer 500 and to a real-time system 510 in a suitable manner.

The sliding mode controller 200, for example, is implemented on the real-time system 510 and a desired value $x_{ref}$ is predefined for said controller. In this case, the sliding mode controller 200 comprises a switching function with initial control dynamics for the hydraulic directional valve 100. A value for the manipulated variable, the voltage u in the present case, is therefore determined using the sliding mode controller 200 and is then set at the electromagnet of the hydraulic directional valve 100.

An actual value x of the position of the piston is determined using the displacement transducer in the hydraulic directional valve 100 and is forwarded both to the real-time system 510 and to the computer 500. Whereas the actual value x in the real-time system is supplied to the sliding mode controller 200 for control, the position x of the piston is evaluated with respect to the dynamics on the computer 500, for example by means of a suitable program, in a step 520.

The first pole $\lambda_1$ of the switching level of the sliding mode controller 200, for example, is then adapted or shifted in a step 530. This makes it possible to quickly and easily find a suitable switching function for desired dynamics by adapting or shifting only a few parameters, for example only the first pole.

What is claimed is:

1. A method for operating a hydraulic valve comprising:

identifying, with a control device, a plurality of positions of a piston over time for a piston in the hydraulic valve using a displacement transducer in the hydraulic valve, the plurality of positions including a present position of the piston and at least one prior position of the piston;

determining, with the control device, a plurality of deviations over time between the plurality of positions of the piston and a predetermined position of the piston that produces a desired volumetric flow through the hydraulic valve, the plurality of deviations including a present deviation e between the present position and the predetermined position of the piston;

determining, with the control device, a first derivative e corresponding to a rate of change of deviation of the piston position over time, and a second derivative e corresponding to an acceleration of deviation of the piston position over time based on the plurality of deviations over time;

determining, with the control device, a switching function output s for controlling the position of the piston based on e, $\dot{e}$, $\ddot{e}$, a first pole value $\lambda_1$ that the control device determines based on a function of e: $\lambda_1(e)$, and a second pole value $\lambda_2$ that the control device determines based on a function of $\lambda_1$, based on a switching function:

$$s(e,\dot{e},\ddot{e})=\lambda_1\lambda_2e-(\lambda_1+\lambda_2)\dot{e}+\ddot{e};\text{ and}$$

operating, with the control device, an electromagnet that applies a force to the piston to move the piston from the present position toward the predetermined position based on the switching function output s.

2. The method of claim 1 further comprising:

determining, with the control device, the first pole value $\lambda_1$ based on the function of e: $\lambda_1(e)=\Delta\lambda|e|+\lambda_0$ where $\Delta\lambda$ is a positive linear gradient that is stored in a computer-readable storage medium and $\lambda_0$ is a value that is less than zero that is that is stored in the computer-readable storage medium.

3. The method of claim 2 further comprising:

increasing, with the control device, an absolute value of $\lambda_0$ to provide faster dynamics for the switching function.

4. The method of claim 2 further comprising:

decreasing, with the control device, an absolute value of $\lambda_0$ to provide slower dynamics for the switching function.

5. The method of claim 2 further comprising:

determining, with the control device the second pole value $\lambda_2$ based on the function of $\lambda_1(e)$ and a predetermined proportional constant value $c_2$ that is stored in the computer-readable storage medium based on a function: $\lambda_2=c_2\lambda_1(e)=c_2(\Delta\lambda|e|+\lambda_0)$.

6. The method of claim 2 further comprising:

determining, with the control device, the second pole value $\lambda_2$ based on the function of $\lambda_1(e)$ and a predetermined proportional constant value $c_2$ that is stored in the computer-readable storage medium based on a function: $\lambda_2=c_2\lambda_1(e)$.

7. The method of claim 1 further comprising:

determining, with the control device, the first pole value $\lambda_1$ based on a square root function of e.

8. The method of claim 1 further comprising:

determining, with the control device, a value of a manipulated variable u based on a function: $u=-\beta\sqrt{|s|}\text{sign}(s)$ where $\beta$ is a proportional gain factor that is stored in the computer-readable storage medium; and operating, with the control device, the electromagnet based on the value of u to move the piston from the present position toward the predetermined position.

9. The method of claim 8 further comprising:

determining, with the control device, the value of the manipulated variable u based on a function: $u=-\beta\sqrt{|s|}\text{sign}(s)+\dot{u}$ where $\dot{u}$ is a derivative of u with respect to time that the control device determines based on a function: $\dot{u}=$ $$\begin{cases} -\alpha\sqrt[3]{|s|}\,\text{sign}(s) & \text{for } |u| \le U_M \\ -u & \text{for } |u| > U_M \end{cases}$$

where $\alpha$ is an integral gain factor that is stored in the computer-readable storage medium and $U_M$ is a predetermined maximum value for the manipulated variable u that is stored in the computer-readable storage medium.

10. A control system for a hydraulic valve comprising:

a control device connected to a displacement transducer in the hydraulic valve that identifies a position of a piston in the hydraulic valve, an electromagnet that is configured to apply a force to the piston to move the piston in the hydraulic valve, and a computer-readable storage medium, the control device being configured to:

identify a plurality of positions of a piston over time for the piston in the hydraulic valve using the displacement transducer in the hydraulic valve, the plurality of positions including a present position of the piston and at least one prior position of the piston;

determine a plurality of deviations over time between the plurality of positions of the piston and a predetermined position of the piston that produces a desired volumetric flow through the hydraulic valve, the plurality of deviations including a present deviation e between the present position and the predetermined position of the piston;

determine a first derivative e corresponding to a rate of change of deviation of the piston position over time, and a second derivative e corresponding to an acceleration of deviation of the piston position over time based on the plurality of deviations over time;

determine a switching function output s for control of the position of the piston based on e, $\dot{e}$, $\ddot{e}$, a first pole value $\lambda_1$ that the control device determines based on a function of e: $\lambda_1(e)$, and a second pole value $\lambda_2$ that the control device determines based on a function of $\lambda_1$, based on a switching function:

$s(e,\dot{e},\ddot{e})=\lambda_1\lambda_2 e-(\lambda_1+\lambda_2)\dot{e}+\ddot{e}$; and operate the electromagnet to move the piston from the present position toward the predetermined position based on the switching function output s.

11. The system of claim 10, the control device being further configured to:

determine the first pole value $\lambda_1$ based on the function of e: $\lambda_1(e)=\Delta\lambda|e|+\lambda_0$ where $\Delta\lambda$ is a positive linear gradient that is stored in a computer-readable storage medium and $\lambda_0$ is a value that is less than zero that is that is stored in the computer-readable storage medium.

12. The system of claim 11, the control device being further configured to:

increase an absolute value of $\lambda_0$ to provide faster dynamics for the switching function.

13. The system of claim 11, the control device being further configured to:

decrease an absolute value of $\lambda_0$ to provide slower dynamics for the switching function.

14. The system of claim 11, the control device being further configured to:

determine the second pole value $\lambda_2$ based on the function of $\lambda_1(e)$ and a predetermined proportional constant value $c_2$ that is stored in the computer-readable storage medium based on a function: $\lambda_2=c_2\lambda_1(e)=c_2(\Delta\lambda|e|+\lambda_0)$.

15. The system of claim 11, the control device being further configured to:

determine the second pole value $\lambda_2$ based on the function of $\lambda_1(e)$ and a predetermined proportional constant value $c_2$ that is stored in the computer-readable storage medium based on a function: $\lambda_2=c_2\lambda_1(e)$.

16. The system of claim 10, the control device being further configured to:

determine the first pole value $\lambda_1$ based on a square root function of e.

17. The system of claim 10 further comprising:

determine a value of a manipulated variable u based on a function: $u=-\beta\sqrt{|s|}\text{sign}(s)$ where $\beta$ is a proportional gain factor that is stored in the computer-readable storage medium; and operate the electromagnet based on the value of u to move the piston from the present position toward the predetermined position.

18. The system of claim 17 further comprising:

determine the value of the manipulated variable u based on a function: $u=-\beta\sqrt{|s|}\text{sign}(s)+\dot{u}$ where $\dot{u}$ is a derivative of u with respect to time that the control device determines based on a function:

$$\dot{u} = \begin{cases} -\alpha\sqrt[3]{|s|}\,\text{sign}(s) & \text{for } |u| \le U_M \\ -u & \text{for } |u| > U_M \end{cases}$$

where $\alpha$ is an integral gain factor that is stored in the computer-readable storage medium and $U_M$ is a predetermined maximum value for the manipulated variable u that is stored in the computer-readable storage medium.

* * * * *